United States Patent [19]

Lawson

[11] Patent Number: 4,914,750

[45] Date of Patent: Apr. 3, 1990

[54] SOUND TRANSDUCER

[75] Inventor: William C. Lawson, Prescott, Ariz.

[73] Assignee: AVM Hess, Inc., Phoenix, Ariz.

[21] Appl. No.: 73,755

[22] Filed: Jul. 13, 1987

[51] Int. Cl.[4] ..... H04R 1/02; H04R 7/00; H04R 9/06

[52] U.S. Cl. ..... 381/152; 381/158; 381/182; 381/185; 381/186; 381/194; 381/202; 381/203; 381/205

[58] Field of Search ..... 381/152, 153, 156, 158, 381/160, 182, 185, 186, 188, 194, 202, 204, 205; 181/161, 163, 172

[56] References Cited

U.S. PATENT DOCUMENTS

| | | | |
|---|---|---|---|
| 1,383,700 | 7/1921 | Egerton | 381/180 |
| 2,341,275 | 2/1944 | Holland | 381/152 |
| 2,392,143 | 1/1946 | Graham | 381/202 |
| 3,033,945 | 5/1962 | Villchur | 381/202 |
| 3,185,767 | 5/1965 | Olson et al. | 381/194 |
| 3,366,749 | 1/1968 | Ries | 381/152 |
| 3,430,007 | 2/1969 | Thielen | 381/152 |
| 3,449,531 | 6/1969 | Ashworth | 381/152 |
| 3,496,307 | 2/1970 | Sotome | 381/202 |
| 3,509,282 | 4/1970 | Ashworth | 381/152 |
| 3,524,027 | 8/1970 | Thurston et al. | 381/152 |
| 3,553,392 | 1/1971 | Liebscher | 381/152 |
| 3,567,870 | 3/1971 | Rivera | 381/152 |
| 3,609,253 | 9/1971 | Ashworth | 381/152 |
| 3,636,281 | 1/1972 | Cozart | 381/152 |
| 3,728,497 | 4/1973 | Komatsu | 381/158 |
| 3,861,495 | 1/1975 | Pearson | 181/163 |
| 3,988,541 | 10/1978 | Boast | 381/98 |
| 4,074,070 | 2/1978 | Gaus | 381/99 |
| 4,152,552 | 5/1979 | Meyer | 381/194 |
| 4,188,711 | 2/1980 | Babb | 29/605 |
| 4,251,045 | 2/1981 | Meyerle | 181/148 |
| 4,303,806 | 12/1981 | Thiele | 381/158 |
| 4,392,027 | 7/1983 | Bock | 381/152 |
| 4,514,599 | 4/1983 | Yanagishima et al. | 381/152 |
| 4,607,382 | 8/1986 | Dijkstra et al. | 381/158 |
| 4,675,835 | 6/1987 | Pfleiderer | 381/117 |
| 4,757,548 | 7/1988 | Fenner, Jr. | 381/152 |

FOREIGN PATENT DOCUMENTS

| | | | |
|---|---|---|---|
| 139302 | 5/1985 | European Pat. Off. | 381/152 |
| 582297 | 8/1933 | Fed. Rep. of Germany | 381/152 |
| 2461258 | 7/1976 | Fed. Rep. of Germany | 381/202 |
| 451178 | 7/1936 | United Kingdom | 381/186 |
| 935222 | 8/1963 | United Kingdom | 381/158 |

*Primary Examiner*—Jin F. Ng
*Assistant Examiner*—Danita R. Byrd
*Attorney, Agent, or Firm*—Neil F. Markva

[57] ABSTRACT

A sound transducer converts electrical signals into mechanical motion. A transducer comprises a transducer housing including a diaphragm section having an inner concave surface and an outer convex surface. A stem element projects outwardly from the diaphragm housing section and has a structural configuration effective to penetrate a panel or sounding board. A securing device is adapted to cooperate with the stem for connecting the diaphragm housing section to the sounding board. An electromagnetic driver assembly is resiliently mounted to the inner surface of the diaphragm housing section. The electromagnetic driver assembly includes an annular magnetic gap and a voice coil assembly located in the magnetic gap. The voice coil assembly includes a coil member having a cylindrical voice coil portion at one end thereof disposed in the magnetic gap and the other end thereof connected to the stem. Several embodiments show various forms of the housing, electromagnetic driver assembly and various couplnig, wiring and anti-resonant mechanisms for attaching the housing to a panel sounding board.

48 Claims, 9 Drawing Sheets

Fig. 5
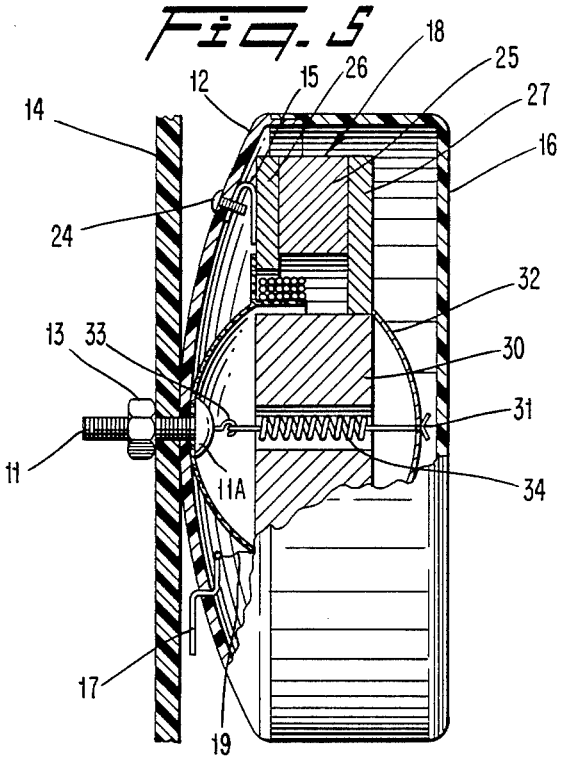
Fig. 6
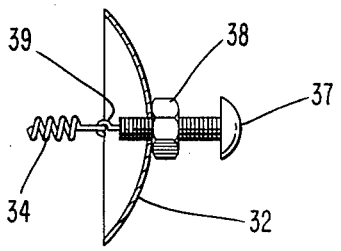
Fig. 7
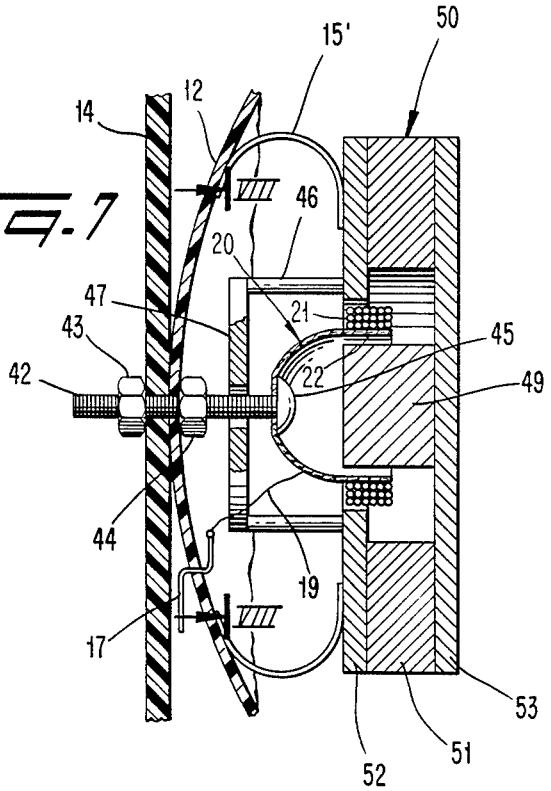
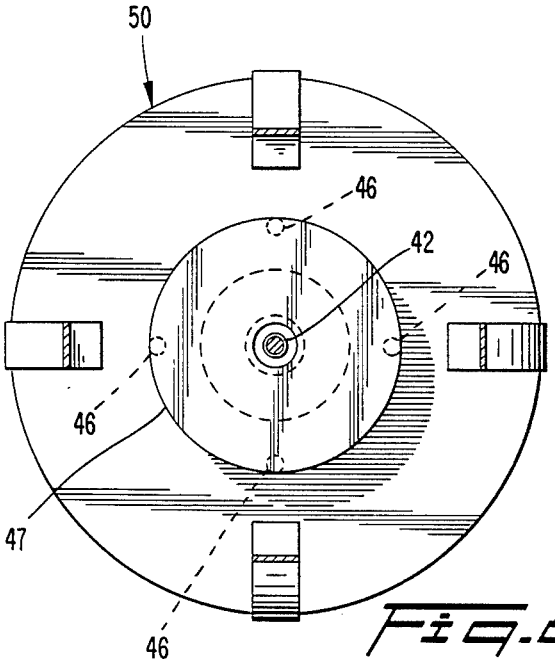
Fig. 8

Fig. 9
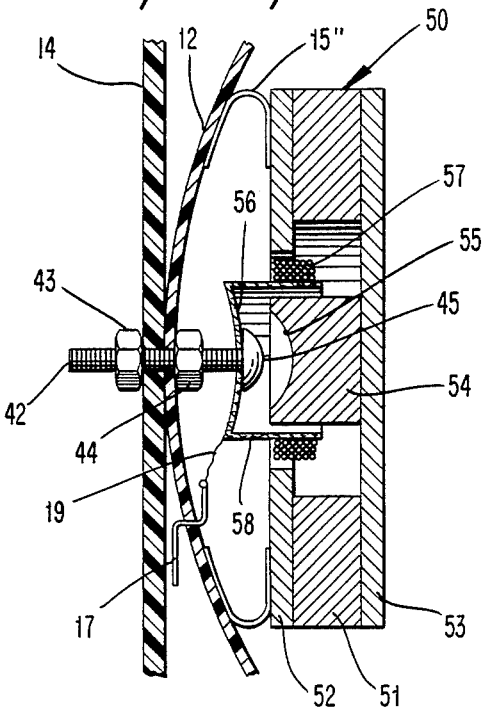
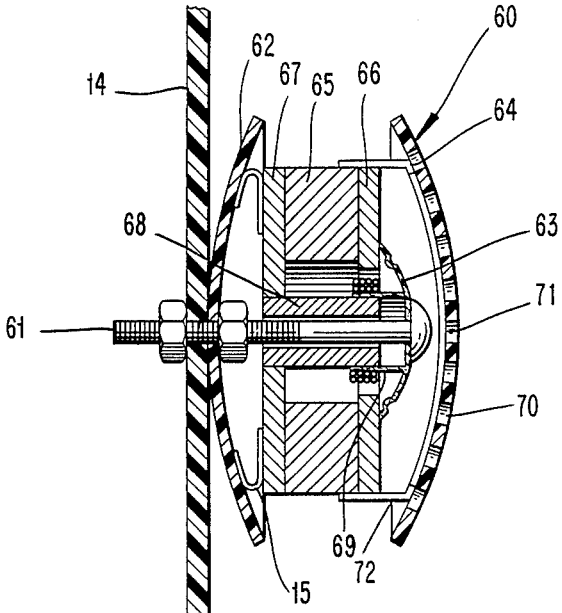
Fig. 10
Fig. 11
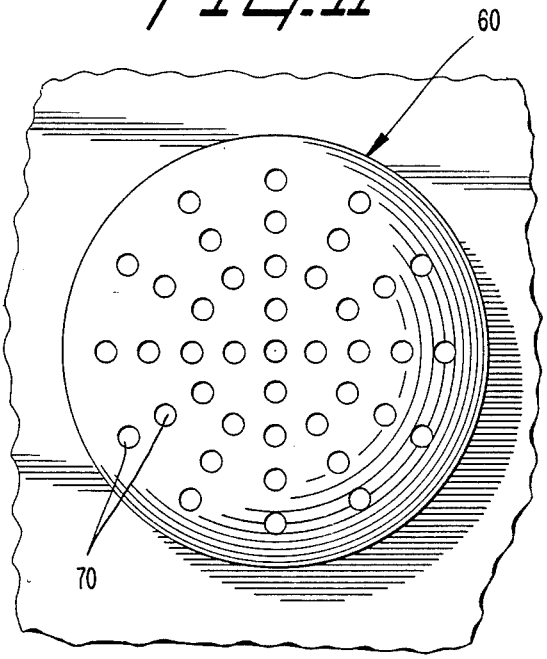
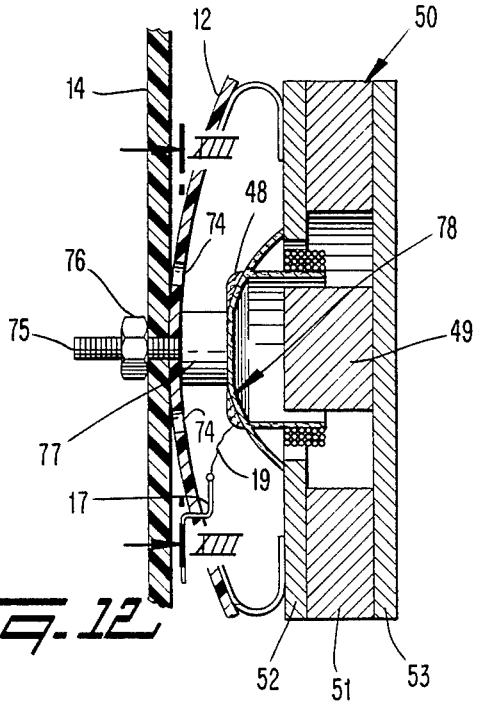
Fig. 12

Fig. 13
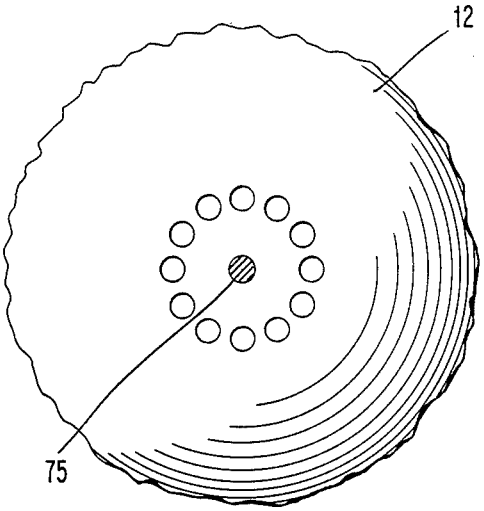
Fig. 14
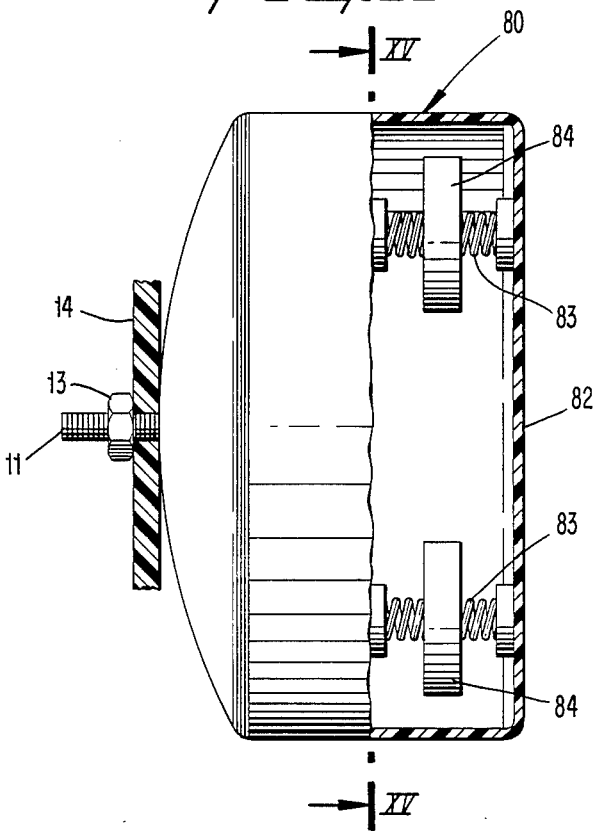
Fig. 15
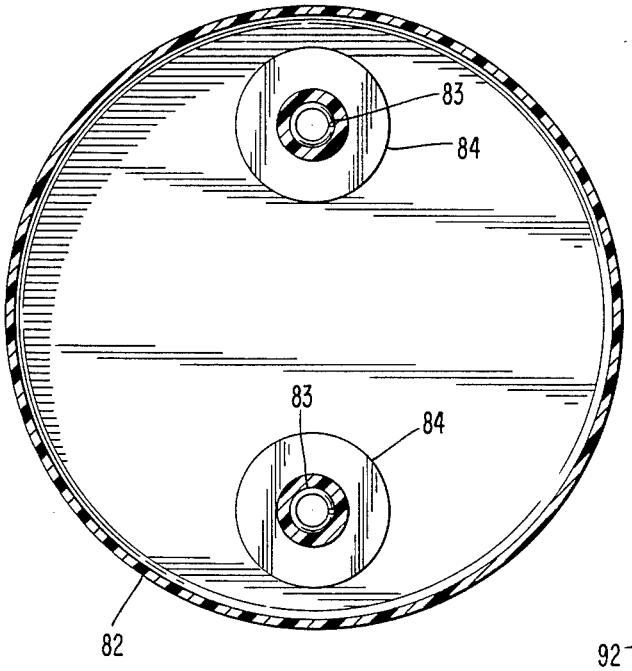
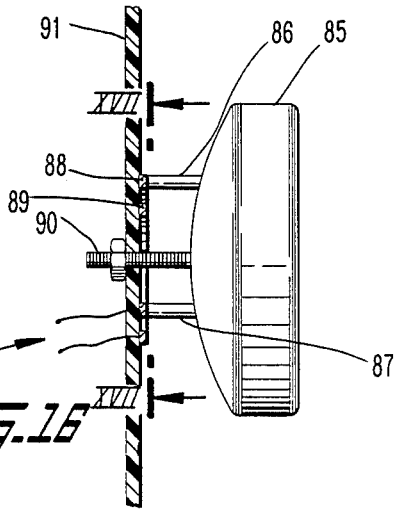
Fig. 16

Fig. 17
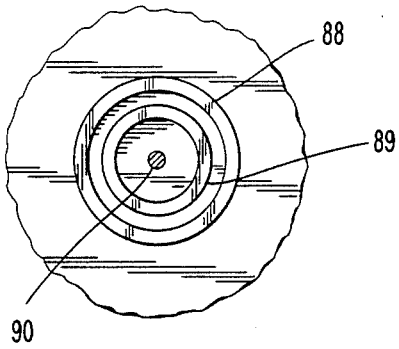
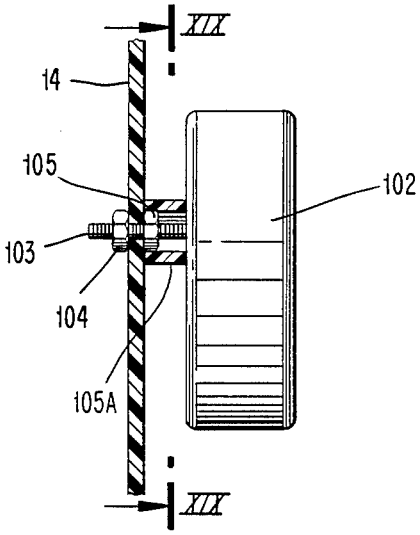
Fig. 18
Fig. 19
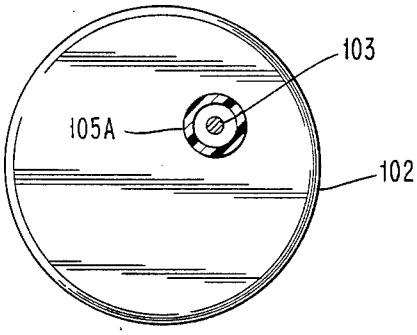
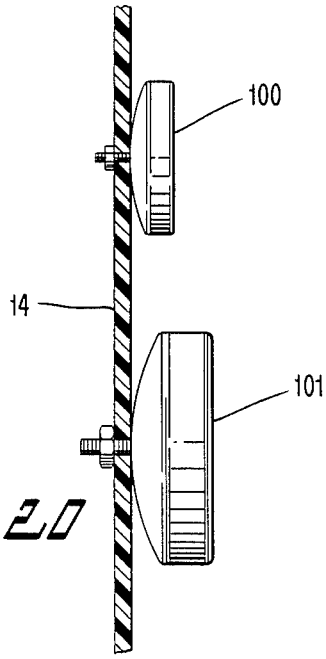
Fig. 20

Fig. 21
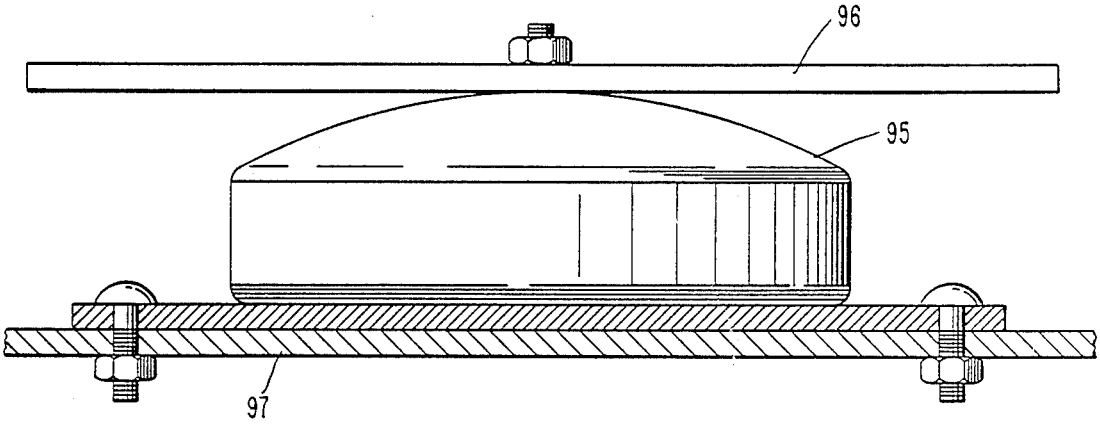
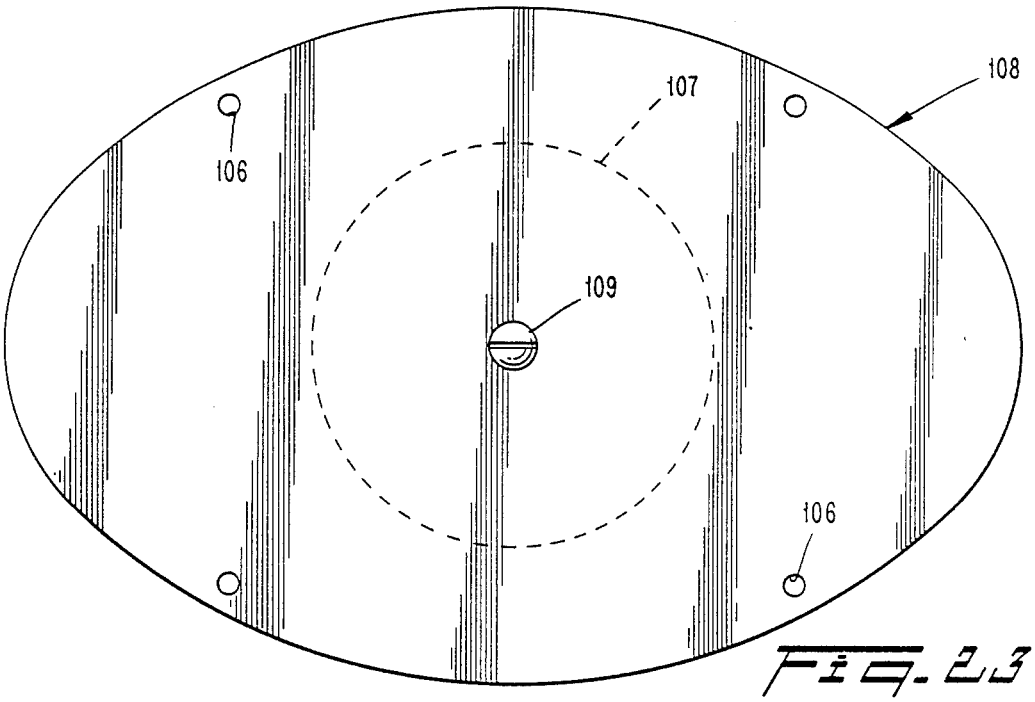
Fig. 23
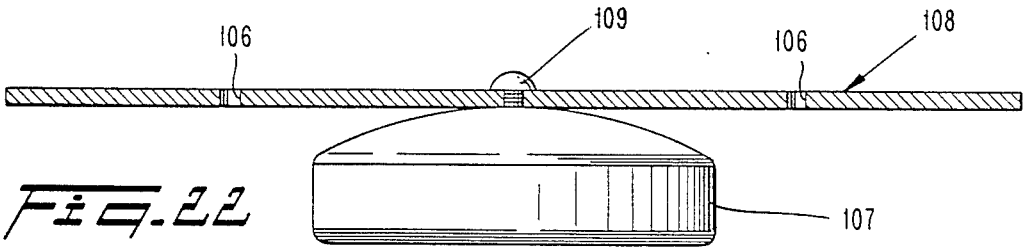
Fig. 22

Fig. 30
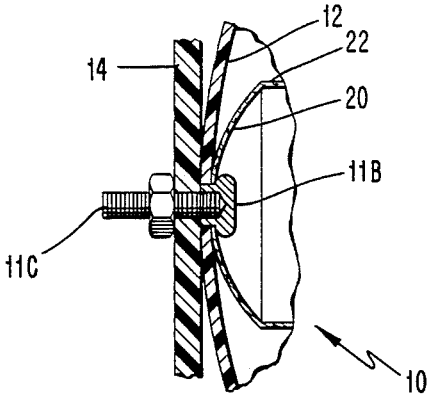
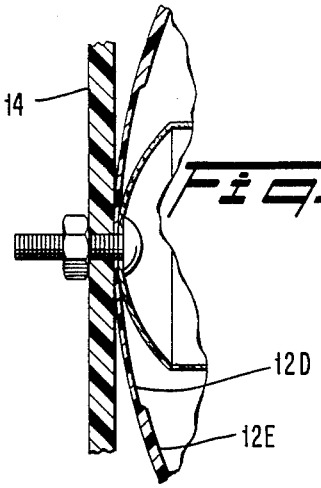
Fig. 31
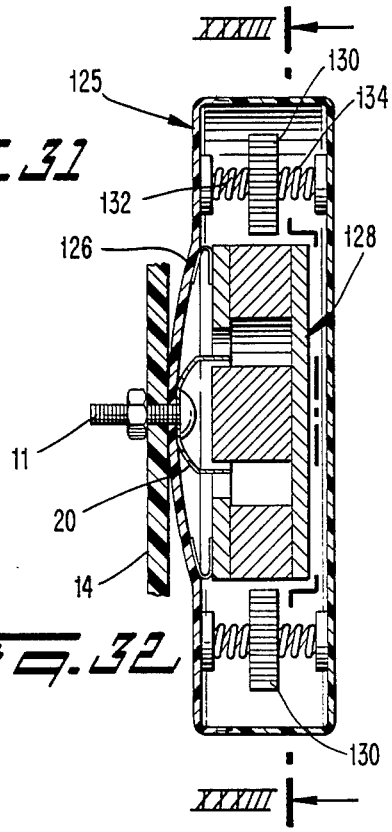
Fig. 32
Fig. 33
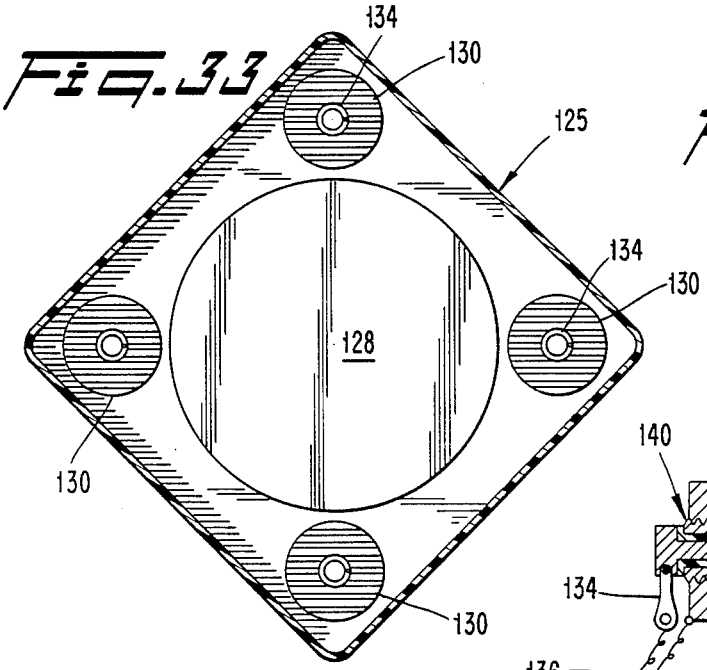
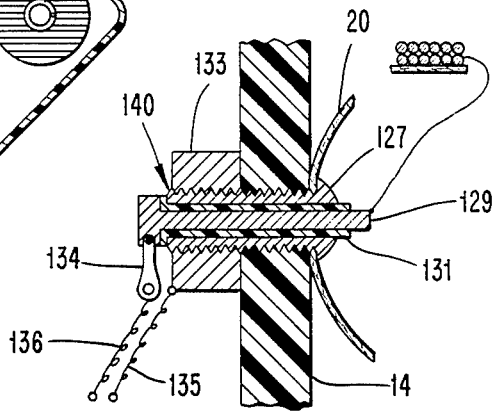
Fig. 34
Fig. 35
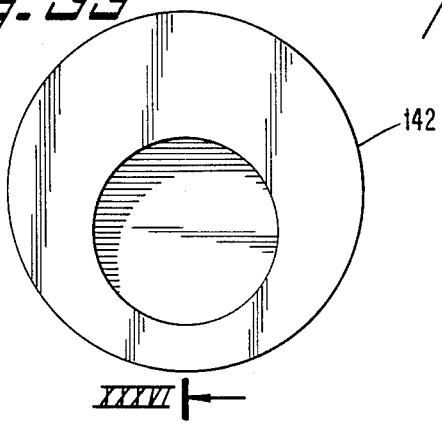
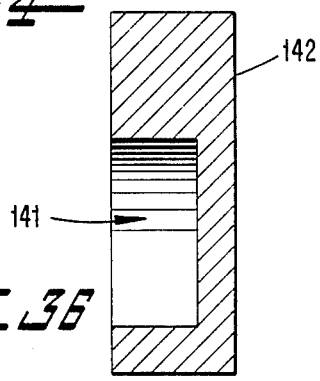
Fig. 36

SOUND TRANSDUCER

FIELD OF THE INVENTION

This invention relates to a sound transducer for converting electrical signals into mechanical motion. More particularly, it relates to a sound transducer for producing sound from a sounding board or panel on which the transducer is mounted.

BACKGROUND OF THE INVENTION

The mounting of a sound transducer on a planar wall panel to produce sound emanating from the wall panel is well known. Each of the following patents disclose various prior art devices having different forms of housings, resonator mechanisms and the like:

1,383,700; 3,524,027;
2,341,275; 3,567,870;
3,366,749; 3,861,495;
3,430,007; 4,514,599;
3,449,531.

Several of these earlier patents disclose the use of a stem or connecting device which secures a housing to a sounding wall panel. Other patents disclose the use of a voice coil assembly having a coil disposed in a magnetic gap of an electromagnetic drive assembly. The use of a resilient mounting mechanism for the electromagnetic drive assembly is also shown to be well known.

Even with all these particular disclosures of various aspects of a sound transducer for converting electrical signals into mechanical motion, the performance ratings of these earlier models are deemed to be ineffective to produce a viable commercial product.

It is the primary purpose of this invention to produce a sound transducer for converting electrical signals into mechanical motion wherein the performance characteristic of such an assembly is sufficient to justify the commercial production and distribution thereof.

Another object of the invention is to produce a sound transducer which may be connected to a sounding board or wall panel using only a single mounting stem with means to match the transducer to the particular panel sounding board being used.

SUMMARY OF THE INVENTION

The transducer of the invention comprises a transducer housing including a diaphragm section having an inner surface and an outer surface. Stem means project outwardly from the diaphragm housing section and have a structural configuration effective to penetrate a panel means. Securing means is adapted to cooperate with the stem means for connecting the diaphragm housing section to a panel means. Resilient mounting means fixedly connect an electromagnetic driver assembly to the inner surface of the diaphragm housing section.

In a specific embodiment, the electromagnetic driver assembly includes an annular magnetic gap and voice coil means located in that gap. The voice coil means includes a coil member having a cylindrical voice coil portion at one end thereof disposed in a magnetic gap and the other end therof connected to the stem mounting means. The coil member includes a conical portion coupled to the cylindrical portion and having a vertex section attached to the stem means which couples the mechanical motion or vibration to the housing diaphragm section and panel.

Another feature of the invention is the construction of a transducer housing wherein the diaphragm section has an inner, dished surface portion and an outer surface portion with an apex region. The securing means is adapted to cooperate with the stem means for fixing the panel means between the apex region of the surface portion and the securing means. Thus, when the transducer housing is fixed against a planar panel means, the combination defines a 360 degree acoustical horn with the planar panel means constituting one wall of the horn. The stem means penetrates the planar wall means with the outer apex surface portion contiguously disposed to one side of the wall means and the securing means coupled to the stem means and contiguously disposed to the other side of the planar wall means.

In another embodiment of the invention, the outer surface portion of the diaphragm housing section includes an annular groove defining an inner center section and an outer annular ring section. The inner center section is effective to vibrate alone at high frequencies thereby acting as a radiating speaker element.

In another feature of the invention, the electromagnetic driver assembly includes a front pole surface facing the diaphragm section and a rear pole surface facing in a direction away from the diaphragm section with a bore opening extending completely therethrough. The driver assembly includes driver anchoring means connecting at one end to the stem means extending through the bore opening and connecting at the other end thereof to a securing member which extends outwardly from the bore opening and contacts the rear pole surface. In a specific embodiment, the anchoring means includes a coil spring section biassingly connecting the securing member to the stem means. The anchoring means may include means for adjusting a biassing force between the stem means and the securing member.

Another feature of the invention is directed to the use of a plurality of spring members constituting the resilient mounting means for the driver assembly and secured at one end to the diaphragm housing section and at the other end to the driver assembly. The mounting means may include means for adjustably securing the spring members to the inner, dished surface of the diaphragm housing section.

Another feature of the invention is directed to a coil member having a conical portion coupled to a cylindrical portion and having a vertex section attached to the stem means. The voice coil assembly may have a coupling means resiliently connecting a voice coil portion to the stem means to retard natural resonances of the panel means.

The invention includes various other features including the use of acoustic damping material disposed on the inner, dished surface portion and on a side of the driver assembly facing the inner, dished surface portion. The housing may include a cover means including a top portion and a skirt portion which extends over the cylindrical section of the transducer housing. A skirt portion may extend forwardly from the rear of the transducer housing to the planar panel means while including a grill section adjacent to the planar panel means. Housing may also include weight means to increase the moment of inertia of the transducer. Such weight means may be integrally formed with the cover means which extends over the cylindrical section of the transducer housing.

Various other features of the invention will become readily apparent upon further consideration of the detailed description of the invention as set forth below.

BRIEF DESCRIPTION OF DRAWINGS

Other objects of this invention will appear in the following description and claims, reference being made to the accompanying drawings forming a part of the specification wherein like reference characters designate corresponding parts in the several views.

FIG. 5 is a fragmentary cross-sectional view of a fourth embodiment of a transducer made in accordance with this invention;

FIG. 6 is a fragmentary, detailed view, partly in section, of an adjusting feature on a transducer made in accordance with this invention;

FIG. 7 is a fragmentary, cross-sectional view of a fifth embodiment of a sound transducer made in accordance with this invention;

FIG. 8 is a sectional view along line VIII—VIII of FIG. 7;

FIG. 9 is a fragmentary, cross-sectional view of a sixth embodiment of a sound transducer according to the invention;

FIG. 10 is a cross-sectional view of a seventh embodiment of a sound transducer made in accordance with this invention;

FIG. 11 is a rear, plan view of the embodiment shown in FIG. 10;

FIG. 12 is a fragmentary, cross-sectional view of an eighth embodiment of a sound transducer according to the invention;

FIG. 13 is a sectional view along line XIII—XIII of FIG. 12;

FIG. 14 is a fragmentary, sectional view of a ninth embodiment of a sound transducer according to the invention;

FIG. 15 is a sectional view along line XV—XV of FIG. 14;

FIG. 16 is a elevational view, partly in section, of a tenth embodiment of a transducer made in accordance with this invention;

FIG. 17 is a sectional view, along line XVII—XVII of FIG. 16;

FIG. 18 is a elevational view, partly in section, of an eleventh embodiment according to the invention;

FIG. 19 is a sectional view along line XIX—XIX of FIG. 18;

FIG. 20 is an elevational view, partly in section, showing a plurality of sound transducers according to the invention mounted on a wall panel;

FIG. 21 is a side elevational view, partly in section, of a sound transducer of the invention mounted on a frame member;

FIG. 22 is a side elevational view, partly in section, showing a transducer having a freely disposed panel diaphragm attached thereto;

FIG. 23 is a top plan view of the sound transducer of FIG. 22;

FIG. 29 is a graph showing the performance characteristics of a transducer according to the invention compared to a prior art transducer device;

FIG. 30 is a fragmentary, cross-sectional view of a thirteenth embodiment of a sound transducer according to the invention;

FIG. 31 is a fragmentary, cross-sectional view of a fourteenth embodiment of a sound transducer according to the invention;

FIG. 32 is a fragmentary, cross-sectional view of a fifteenth embodiment of a sound transducer according to the invention;

FIG. 33 is a sectional view along line XXXIII—XXXIII of FIG. 32;

FIG. 34 is a fragmentary, cross-sectional view of a sixteenth embodiment of a sound transducer according to the invention;

FIG. 35 is a plan view of a fourth embodiment of a cover member for a transducer made in accordance with this invention; and FIG. 36 is a sectional view along line XXXVI—XXXVI of FIG. 35.

DETAILED DESCRIPTION

Figure 1:
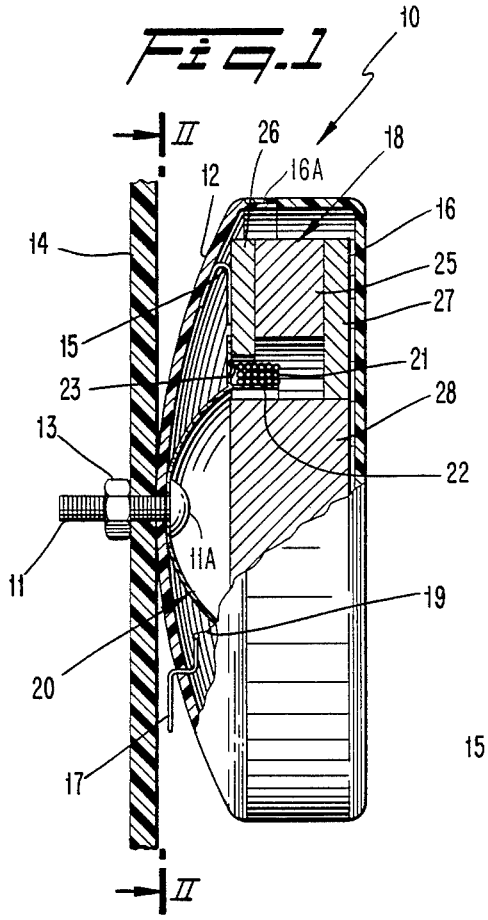
FIG. 1 is a fragmentary, cross-sectional view of a transducer made in accordance with this invention.
Figure 2:
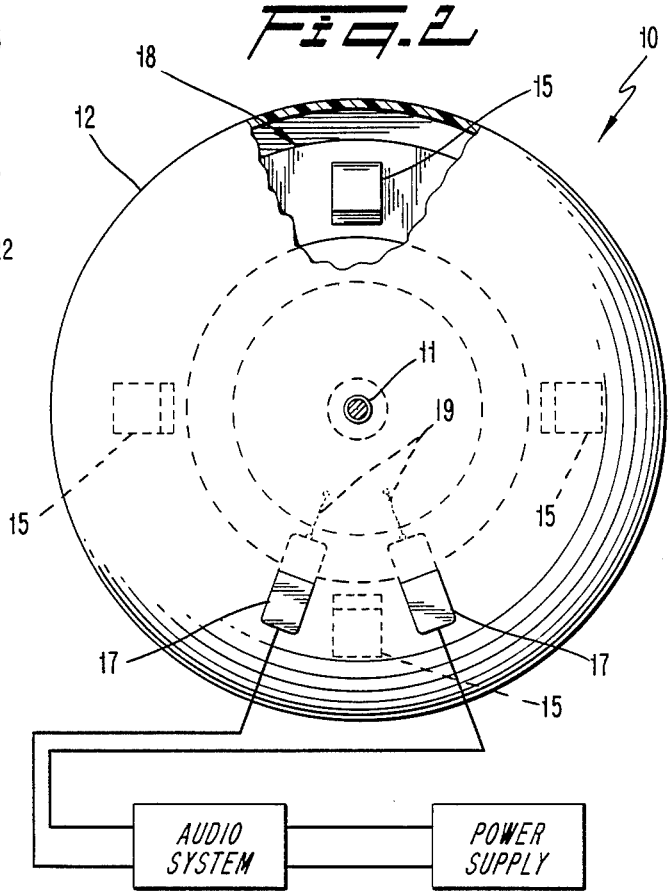
FIG. 2 is a fragmentary, sectional view along line II—II of FIG. 1.

In FIGS. 1 and 2, a sound transducer, generally designated 10, comprises a transducer housing including a diaphragm section 12 and a rear cover section 16 bonded together at the connection 16A. In this embodiment, the diaphragm housing section 12 has an inner, dished surface portion and an outer surface portion with an apex region contacting the planar wall panel 14.

A stem 11 has a head 11A at the inner end thereof and is threaded along its outer surface. A nut 13 is adapted to cooperate with the stem 11 for fixing the planar panel section 14 between the apex region of the dished surface portion and the securing nut 13. Thus when the transducer housing is fixed against the planar panel section 14 the combination defines a 360 degree acoustical horn with a planar panel constituting one wall of the horn.

A voice coil assembly 20 includes a cylindrical support portion 22 on which a coil 21 is wound. The annular skirt compliance portion 23 is bonded to the front face of an electromagnetic assembly as described below. Electrical contacts 17 extend through the diaphragm housing section 12 and are connected to the coil 21 via lead wires 19. A conical portion of the coil assembly 20 is coupled at one end to the cylindrical portion 22 and has a vertex section with an opening through which the stem 11 projects. Thus, vibrations are transmitted to diaphragm section 12 and panel section 14.

Four spring elements 15 are circumferentially spaced around the front face of an electromagnetic driver assembly, generally designated 18. One end of the springs 15 is fixedly bonded to the inner, dished surface portion of diaphragm housing section 12 and at the other end to an annular, circular disk 26 which comprises a front pole member of driver assembly 18. Epoxy resin or screw member 24 (FIG. 5) may be used to secure either end of springs 15. With screw 24 springs 15 may be adjustably secured to the inner, dished surface of the diaphragm section 12. Three or more U-shaped leaf springs 15 may be used.

The resilience and damping of springs 15 can be varied by changing thickness and/or placing room temperature vulcanizing (RTV) silicone material around them. The thickness and width of springs 15 are dependent upon the amount of compliance desired when combined with a particular driver mass.

Driver assembly 18 includes a cylindrical ring magnet 25 having a circular disk, rear pole member 27 on a rear side facing in a direction away from the diaphragm section 12. An annular disk, front pole member 26 is disposed on a front side facing the the diaphragm housing section 12. A center post section 28 extends from the rear side to the front side of driver unit 18 with a magnetic gap extending between the outer surface of the cylindrical center post and the inside circumferential surface of the front pole member 26. The configuration of such an electromagnetic unit 18 is well known.

The cylindrical voice coil portion 22 with wire coil 21 is disposed in the magnetic gap with the other end of the voice coil assembly 20 connected to the stem 11 as shown.

In operation, the contacts 17 are electrically connected to the audio system on which the electrical signals are produced with the transducer 10 being effective to convert those electrical signals into mechanical motion. The vibration is transmitted via the motion of wire coil 21 with respect to the electromagnetic driver unit 18 which is resiliently secured to the inner, dished surface portion of diaphragm housing section 12 and the stem 11 to the wall panel 14.

Figure 3:
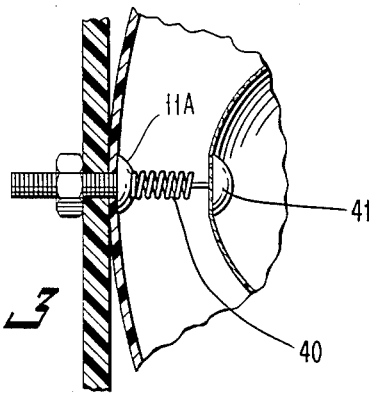
FIG. 3 is a detailed fragmentary, cross-sectional view of another embodiment of a sound transducer of the invention.

FIG. 3 shows a spring 40 fixed to the head 11A via soldering or welding. A holding head 41 is on the inside of the conical portion of voice coil assembly 20. The other end of spring 40 is connected to the holding head 41 as shown. Spring 40 has a proper stiffness to resonate with the panel mass 14 and motor mass 18 to produce the desired results. Electromagnetic driver 18 can weigh about one pound. In this embodiment, spring 40 is sufficiently stiff to resonate with the electromagnetic driver unit 18 at low frequencies in the audio spectrum.

Figure 4:
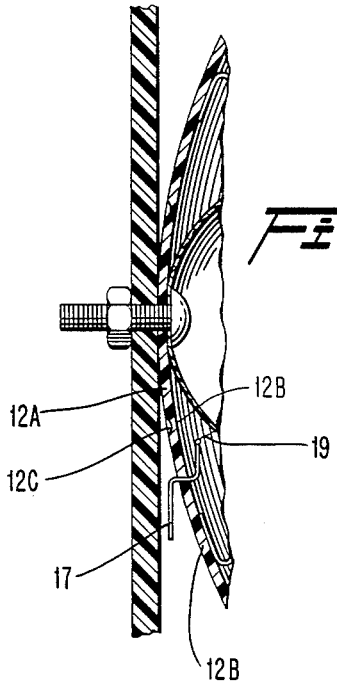
FIG. 4 is a fragmentary, cross-sectional view of a third embodiment of a transducer according to the invention.

The embodiment of FIG. 4 is substantially identical to the embodiment as shown in FIG. 1 except for the annular groove 12C located on the outer surface portion of the diaphragm housing section 12. The annular groove 12C provides a flexible, spring-like portion 12B disposed around an inner apex region 12A which acts as a high frequency diaphragm to radiate sound.

Typical dimensions for a transducer made in accordance with this invention are from about one inch outside diameter to over six inches for a low frequency driver. However, larger diameter sizes may be used. A stem 11 is bonded or molded to diaphragm housing section 12, as shown in the transducer of the present invention. The nut 13 secures the transducer assembly of the housing and electromagnetic driver unit to the wall panel 14 in each instance. The shape of the housing as shown in the early embodiments is circular. However, the housing may be elliptical, triangular, square, rectangular or any other desired shape when viewing the transducer 10 from the rear end thereof opposite the wall panel 14.

All spring means can benefit from possible inclusion of mechanical damping means such as viscous fluid, like "STP". Such damping adjusts the "Q" of the resonant system comprising the spring compliance with the attached mass. A well-damped, or low Q system has a gentle, broad resonant curve covering a wider range of frequencies. A lightly-damped or high Q system has a sharply defined frequency peak and operates primarily at one frequency. Both high and low Q systems are desirable depending upon what is being accomplished.

FIG. 5 shows an embodiment wherein the electromagnetic driver unit 18 includes a cylindrical portion 30 having a bore opening extending completely therethrough. A driver anchoring member 34 is a spring connected at one end to the stem head 11A and extends through the bore opening and is connected at the other end to a securing or anchoring member 32 which projects outwardly from the bore opening and contacts the outer surface of the rear pole member 27. Connecting means 31 are used to fix the driver anchoring spring 34. A hook member 33 is bonded to the head 11A of stem 11. All of the other aspects of the unit shown in FIG. 5 are like those discussed with respect to the embodiment shown in FIG. 1.

The dome shaped anchoring member 32 is circular with cutouts of brass about one inch in diameter and about 0.030 inch thick. However, the configuration of this anchor member 32 may take any configuration to accomplish the desired results.

The embodiment as shown in FIG. 6 includes a spring 34 attached to a hook 39 secured to the bottom of a bolt 37. A nut 38 is in threaded engagement with the bolt 37 and allows for the adjustment of tension on spring 34. A viscous sealing agent may be applied to keep the thread of bolt 37 from vibrating loose. Viscous damping material may be applied to spring 34 to control system Q.

In the FIGS. 7 and 8, an electromagnetic driver assembly 50 includes a cylindrical ring magnet 51 having a circular disk, rear pole member 53 on the rear side facing in a direction away from diaphragm section 12, a circular disk, front pole member 52 on a front side facing the diaphragm housing section 12 and a center post member 49. The conical voice coil member 20 is bonded to the head member 45 with epoxy resin in this instance with the cylindrical coil support 22 and coil 21 disposed in the magnetic gap. The bolt 42 is threaded on the outside surface thereof and is held in place via inside nut 44 and outside nut 43 to fix the outer surface of diaphragm housing section 12 against the wall panel 14 as shown. Bolt 42 passes through a ring member 47 forming an annular gap therebetween. The gap or clearance between bolt 42 and ring 47 is filled with a viscous damping material. Ring 47 is supported in this embodiment by four posts 46. Three posts may be used or a solid cylinder or any number of various support means may also be used to suspend ring 47 around the bolt 42 as shown. As in all of the earlier embodiments, spring members 15' hold the electromagnetic drive assembly on the housing section 12. The bolt 42 supports the housing 12 onto wall panel 14.

The embodiment shown in FIG. 9 for the stem 42 includes a different configuration for the voice coil mechanism attached to the head 45 of stem 42. A dished or concave coil coupling member 56 is connected to the cylindrical support portion 58 on which voice coil 57 is wound. The center post 54 of electromagnetic driver unit 50 has a recessed center portion 55 as shown. Again, bolt 42 holds the wall panel 14 and diaphragm housing section 12 together and is driven by the voice coil portion 56.

It is conceivable that the springs 15" which are the same as in the early embodiments may be a full 360 degree ring having a continuous U-shape cross section therearound. The recessed magnetic center pole portion 55 allows the use of a concave voice coil coupling member 56 instead of the conventional convex voice coil cap as used in the earlier embodiments. This design allows a thinner overall housing depth and allows the center of mass of the transducer to be closer to panel 14 thereby decreasing the gravitational stress of bolt 42 and diaphragm housing section 12.

In the embodiment of FIGS. 10 and 11, voice coil assembly 63 is disposed on the rear side of an electromagnetic drive member having a ring magnet 65 and a front pole member 67 and a rear pole member 66. Magnetic gap is located between the rear pole member 66 and the hollow center post 68 as shown. The cylindrical support 69 of voice coil assembly 63 extends into the annular gap. Voice coil assembly 63 is bonded to the head of bolt 61 maintained in place by nuts on the outside of wall panel 14 and the inside of dished diaphragm housing section 62 as shown. Copper wire may be wound on an aluminum cylinder support 69 with flexible leads connecting the voice coil to terminals as in earlier embodiments.

The particular feature of the invention is directed to the hollow, center magnetic pole piece 68 with the bolt 61 extended therethrough to couple the wall panel 14 to the dome shaped assembly 63 on the outside of the assembly. This allows direct radiation of the high frequencies for coaxial operation of the panel transducer 60. This design also allows minimal panel to transducer spacing for a thinner overall depth thus keeping the entire mass of the system close to the wall section 14. The outer rear diaphragm housing section 64 includes openings 70 which are covered on the inside by acoustical resistance material 72. The outer rear diaphragm housing section 64 is mounted to a base support member 71 which fits over the cylindrical outer surface of the driver unit including the rear pole member 66 and ring magnet 65.

The embodiment as shown in FIGS. 12 and 13 is a variation of the embodiment shown in FIGS. 10 and 11. In each of these situations, the high frequency radiating diaphragm housing section is nearest the panel. The high frequency sound comes from inside the housing and radiates through openings 74 to drive the horn. The sound is produced by a secondary cone or diaphragm attached to the same voice coil as drive bolt 75 for mid and low frequency sound. The stem 75 is threadingly engaged to nut 76 on one side of wall panel 14 with an enlarged head 77 providing a shoulder for holding the diaphragm housing section 12 in place. A novel voice coil-cone assembly 78 includes a secondary, low mass tweeter cone 48 attached to the coil. In this transducer, at high frequencies, the mass of bolt 75 is too high to allow voice coil motion to drive it. However, the coupling becomes sufficiently flexible at these higher frequencies such that the voice coil-cone assembly 78 can still move and effectively drive the small, thin, low mass tweeter core 48 and radiate useful sound. Epoxy resin is used to bond the shoulder of bolt head 77 to housing section 12 and to the coil assembly 78.

The transducer 80 as shown in FIGS. 14 and 15 includes a cover housing 82 defining a resonator chamber in which masses 84 are mounted between spring members 83 as shown. Resonator mechanism thereby includes at least one mass so that it is possible to control the sounds emanating from transducer 80 and panel 14. By proper selection of the springs 83 and viscous or other damping material on the springs, weights 84, the resonator mechanism can cover several notes of the musical scale. Each transducer has a fundamental resonant frequency determined by the amount of mass found in the electromagnetic driver unit and in the compliance of springs 15 as discussed in the earlier embodiments. Each added mass 84 has a resonant frequency with its own springs 83.

The embodiment as shown in FIGS. 16 and 17 incorporates a different electrical connecting system wherein annular connecting rings 88 and 89 are disposed around a stem 90 for supporting the transducer drive mechanism 85. The contacts 86 and 87 are electrically connected to the voice coil inside transducer 85. When the unit 85 is in threaded engagement to the wall panel 91, the electrical contacts 86 and 87 meet annular ring contacts 88 and 89, respectively. Leads 92 are connected to the audio power system to drive the transducer assembly of the embodiment. Alternatively, stem 90 may be used as one electrical terminal while only one ring contact 88 and spring electrical contact 86 need be used to complete the circuit.

The feature of the invention as shown in FIGS. 18 and 19 provides a mounting bolt 103 fixing the transducer assembly 102 to panel 14 via nuts 104 and 105 with spaces sleeve 105A. Bolt 103 is located eccentrically with respect to the circular, cylindrical housing 102. Thus, transducer housing 102 is positioned so that the heavier, off-center portion is located to the right of bolt 103 for a right-hand thread. Consequently, the greater mass tends to keep bolt 103 tight to wall panel 14. This prevents the transducer from vibrating loose thereby causing any buzzing or rattling during operation.

FIG. 20 shows a disposition of two transducers 100 and 101 fastened to the same wall panel 14. Typically, one transducer 100 may be designed for high frequency radiation from the panel 14 while the other transducer 101 may be larger and more massive thereby designed to more effectively reproduce lower frequencies through the same wall panel 14.

The embodiment of FIG. 21 shows how the transducer made in accordance with this invention may be anchored along its rear side to a frame support of a vehicle. Here the driver housing 95 is fastened directly to the motor vehicle frame 97. The diaphragm portion 96 is supported by the driver unit 95 in a fashion as set forth hereinabove. The diaphragm may be mounted directly in openings intended for conventional loudspeakers. The housing 95 acts as the sole support means for a low-mass, stiff diaphragm member 96.

The embodiment as shown in FIGS. 22 and 23 is similar to that shown in FIG. 21 but the connecting of the transducer 107 is directly to the diaphragm 108 which supports the driver housing 107 via stem 109. The diaphragm may be shaped in a standard fashion with openings 106 provided to connect diaphragm 108 directly to the standard speaker opening found, for example, in vehicles. The transducer housing 107 may be disposed either above or below the panel to which the diaphragm 108 is connected.

Figure 24:
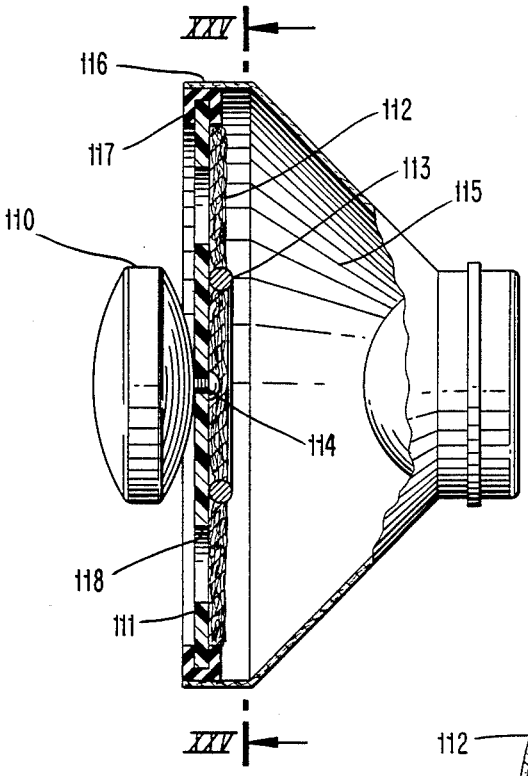
FIG. 24 is a fragmentary, cross-sectional view showing a twelfth embodiment of a sound transducer mounted over a further loudspeaker to form a loudspeaker combination.
Figure 25:
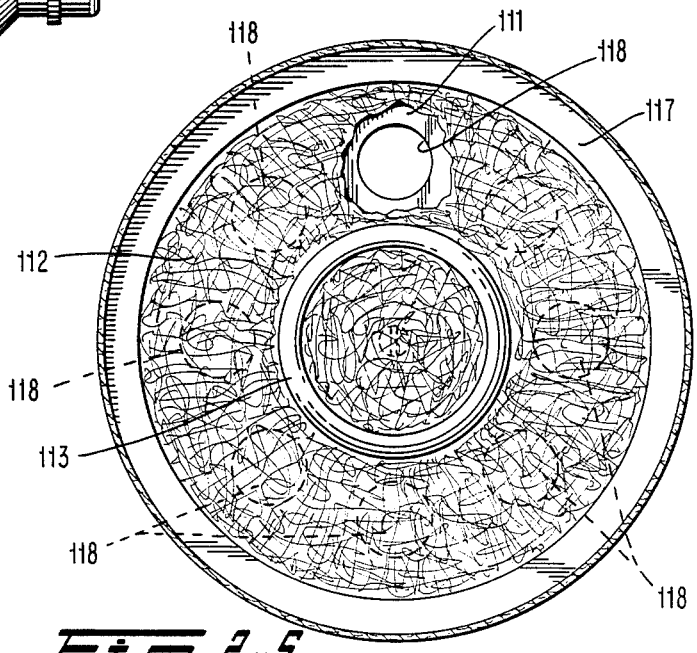
FIG. 25 is a sectional view along line XXV—XXV of FIG. 24.

FIGS. 24 and 25 show a panel diaphragm 111 having a shape and size to fasten directly over a conventional loudspeaker 115 thereby forming a speaker combination. The panel diaphragm 111 is effective to allow low frequency sound to pass through the panel diaphragm 111 which supports the transducer housing 110 via stem 114. Panel diaphragm 111 includes perforations 118 through which the low frequency sound may pass from the loudspeaker cone 115. Acoustical damping material 112 is disposed on the side of the diaphragm 111 opposite the side supporting the transducer housing 110. The damping material 112 is effective to reduce standing waves that create peaks and dips in the frequency response of the speaker combination as shown. A weight ring 113 is secured to a side of the panel diaphragm 111 to control panel resonance and standing waves. The annular ring 113 is bonded to the panel diaphragm 111 as shown. Resilient mounting ring 117 extends around the outer periphery of diaphragm 111 and is connected to the inside of the outer speaker flange 116 as shown. The resilient mounting ring 117 is effective to improve durability and frequency response of the speaker combination.

Figure 26:
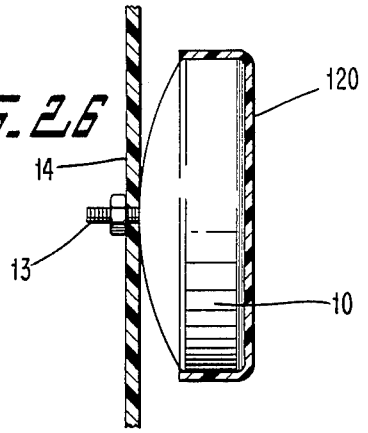
FIG. 26 is a partial sectional view showing a cover member for a sound transducer according to the invention.
Figure 27:
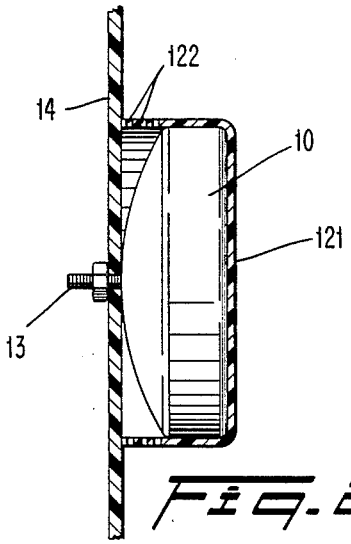
FIG. 27 is a partial sectional view showing another embodiment of a cover member for a sound transducer according to the invention.

Another feature of the invention is directed to the decorative covers 120 and 121 shown in FIGS. 26 and 27 respectively. Here the covers 120 and 121 are shaped like a cup or bowl and slip over the transducer housings as shown. This allows field replacement to match cosmetic requirements such as color, texture and the like. Covers 120 and 121 may be glued in place or held with other coupling mechanisms such as Velcro. Cover 121 is acoustically transparent with the cylindrical portion 122 nearest the open end made of acoustic grill cloth, open cell urethane foam or the like to allow sound to pass through from the apex of the transducer where it contacts the wall 14.

Figure 28:
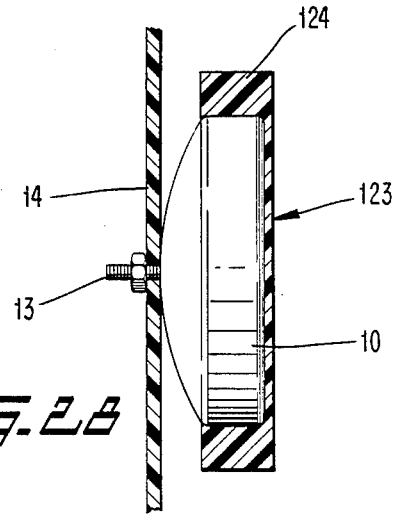
FIG. 28 is a partial sectional view showing a third embodiment of a cover member for a transducer made in accordance with this invention.
Figure 2:
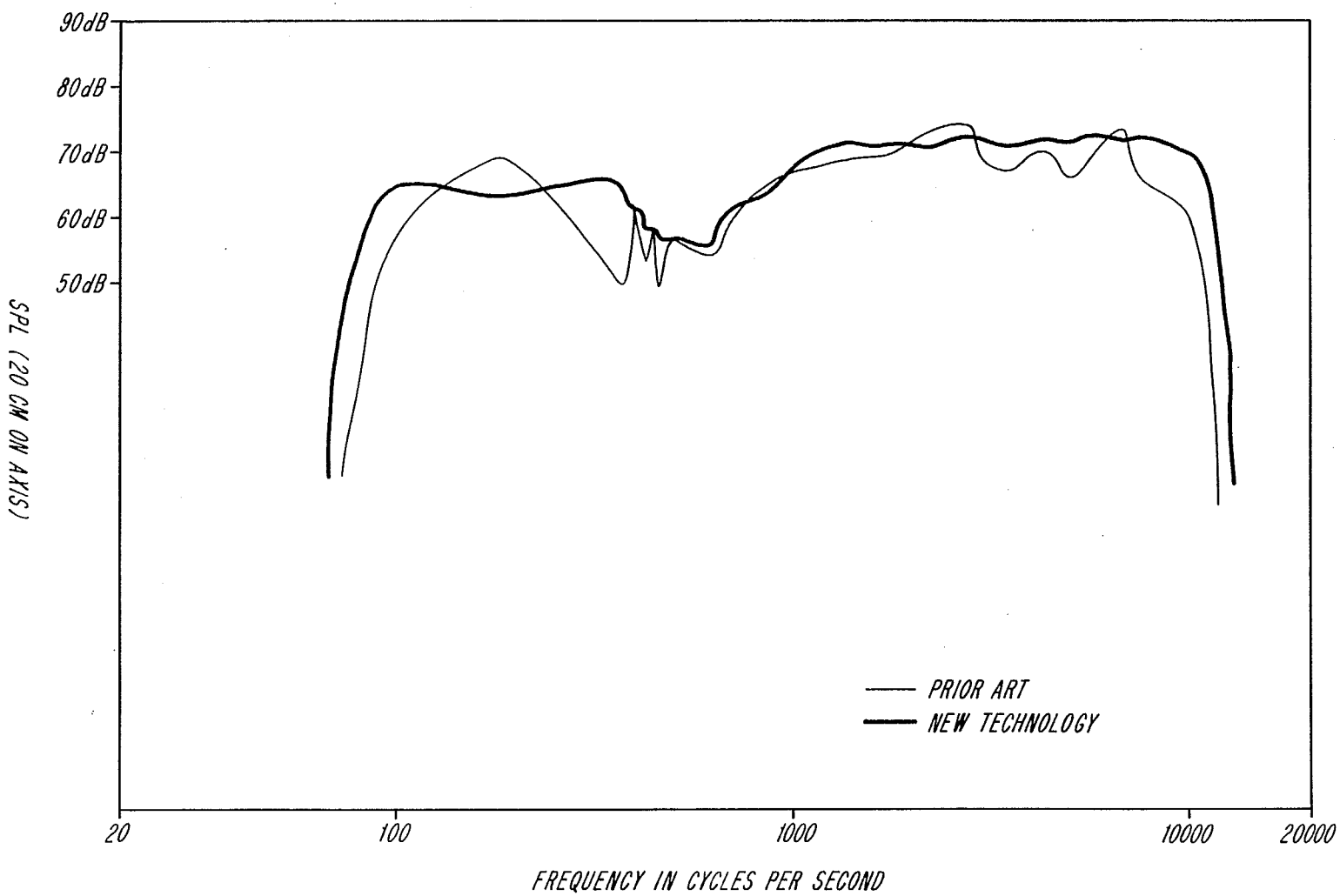

The embodiment shown in FIG. 28 shows a decorative cover having an added mass formed in an annular ring 124 connected to the top portion 123. The weight 124 adds mass to the transducer 10 providing a greater mass for electromagnetic drive assembly to work against for vibrating the wall panel 14. This produces a greater low frequency output.

FIG. 29 shows a graph of empirical data comparing a transducer made in accordance with this invention with a prior art transducer such as that shown as by the U.S. Pat. No. 3,524,027. The panel transducers were mounted on a one-half inch thick gypsum board mounted on eighteen inch centers. A perfect transducer would be a straight line across the graph for the various frequency values. Any deviation from a straight direction, showing dips or peaks represents a distortion in the signal. The solid line shows fewer dips and peaks and in general, constitutes a significant improvement regarding the performance curve.

In an intermodulation distortion test where there is a mix of a signal at 100 hertz with another signal at 500 hertz with a subsequent look at the product performance, the prior art transducer would read greater than 25% distortion. However, with the transducer made in accordance with this invention, there would be less than 3% distortion. Such distortion produces a fuzzy and nebulous signal that is not clearly defined. The curves as shown in FIG. 29 are typical of this type of transducer system mounted on framing and clearly shows the significant improvement achieved by applicant's device.

FIG. 30 discloses a stem means including a stud member 11C having outer threads and a female insert member 11B having inner threads which engage the outer threads of the stud member 11C. The female insert member 11B extends through the diaphragm section 12 to hold it against the panel 14. A further standard nut is used at the outer end of the stud member 11C as in the earlier embodiments.

FIG. 31 discloses a transducer system having a housing with a convex, dish-shaped side with a thin center section 12D defined by a reduction in wall thickness so that the center of the diaphragm section is free to vibrate as a radiator of acoustical energy. An outer, annular diaphragm section 12E surrounds the inner, center section 12D.

The embodiment of a sound transducer system as shown in FIGS. 32 and 33 include a housing 125 with a diaphragm section 126 fixed to wall panel 14 via stem 11 as in the earlier embodiments. An electromechanical motor 128 is resiliently mounted to the diaphragm section 126 as shown. Here weights 130 are placed along side the electromechanical motor 128 between pairs of spring members 132 and 134 as shown. This embodiment maintains the total mass closer to the panel 14. As shown, four separate weights 130 are mounted at the corners of the rectangular housing 125. A triangular housing may also be used with three weights located at the corners of such a triangular shape. A cylindrically shaped housing may also be used in place of the rectangular housing 125 with any number of weights added around the periphery of the electromechanical motor 128.

FIG. 34 shows a coaxial bolt assembly 140 including a hollow bolt member 127, a pin member 129 and an electrical insulating sleeve member 131. Bolt member 127 has a central bore which receives the pin member 129 with the sleeve member 131 being disposed in the bore between the pin member 129 and 127 as shown. Electrical wire leads 135 and 136 are connected to bolt 133 and spring contact 134, respectively, to complete the circuit for transmitting the audio signals to the transducer from the amplifier system to which it is attached.

The embodiment of FIGS. 35 and 36 disclose the use of a cover member have eccentrically located weight means. The center opening 141 is shaped to fit over a transducer housing in the same fashion as the cover shown in FIG. 28. The only difference is that the cover member 142 is eccentrically weighted as shown.

The audio transducers of the present invention are useful for driving panels in the forms of walls, floors, ceilings, vehicle interiors, and the like for the radiation of sound. Shape factors and mounting means contribute to lower distortion and higher efficiency and reduced bending and deformation of transducer housing and mounting means due to fatigue over time. New internal coupling means, mechanical biassing means and motor mechanisms improved linearity. Multi-motor and multi-diaphragm systems improve response. Combining conventional loud speaker with panel coupling means extends the frequency response.

Replaceable dust shields and decorative covers improve appearance where transducer is exposed. Externally adjustable mechanical impedance control allows optimum matching to various panel materials. Built-in terminals between transducer and mounting means eliminate wiring problems. Placing matching transformers, amplifiers, power supplies or accessory weights on the transducer improves low frequency response. Coupled resonant systems within the housing cancel out panel resonances.

Where the housing of the transducer includes one or more mass elements, such elements are supported by compliant springs wherein the mass-spring systems have natural resonant frequencies differing from the natural resonant frequency of the motor mechanism and from one another by a factor of about 1.059 to 1.414. This approach utilizes the effect of the system resonances to enhance low frequency performance.

The preferred curvature of the housing defines an exponential curve to efficiently couple high frequency sound vibrations radiated at the apex of the diaphragm section 12 to the free air. Thus, when the panel 14 is flat with the curve from the wall and from the transducer going out, the cross-sectional area varies exponentially with respect to the distance from the center of the apex region.

Housing 12 may be made from injection molded plastic material such as a glass-filled polycarbonate. The thickness is in the range of from about 0.035 to about 0.090 inch with the specific embodiments being about 0.070 inch in thickness. With the embodiment of FIG. 31, the thin inner center section 12D has a thickness of about 0.040 inch with the thickness of outer annular section 12E being about 0.070 inch.

While the sound transducer has been shown and described in detail, it is obvious that this invention is not to be considered and limited to the exact form disclosed, and that changes in detail and construction may be made therein within the scope of the invention without departing from the spirit thereof.

Having thus set forth and disclosed the nature of this invention, what is claimed is:

1. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, and (e) resilient mounting means secures an electromagnetic driver assembly to the inner, dished surface portion of the diaphragm section, (f) the electromagnetic driver assembly includes a cylindrical ring magnet having a circular disk, rear pole member on a rear side facing in a direction away from the diaphragm section, a circular disk, front pole member on a front side facing the diaphragm section and a cylindrical bore member having an outer surface and extending through the ring magnet between the front and rear sides, (g) an annular magnetic gap is located between one of the disk pole members and the outer surface of the cylindrical bore member, and (h) the voice coil means including a coil member having a cylindrical voice coil portion at one end thereof disposed in the magnetic gap and the other end thereof connected to the stem means.

2. A transducer as defined in claim 1 wherein
the housing includes a cylindrical section projecting outwardly from the inner dished surface portion and defining an outer rear end.

3. A transducer as defined in claim 2 wherein
the dished surface portion has an outer peripheral edge, and
the cylindrical section extends outwardly from the peripheral edge.

4. A transducer as defined in claim 1 wherein
the panel means is a planar panel means,
the stem means penetrates the planar panel means with the outer apex surface portion contiguously disposed to one side of the planar panel means and the securing means coupled to the stem means and contiguously disposed to the other side of the planar panel means.

5. A transducer as defined in claim 1 wherein
the housing includes an opening at the center of the dished surface portion,
the stem means includes a threaded bolt member adapted to project through said opening, and
the securing means includes a nut member for threaded engagement with the bolt member.

6. A transducer as defined in claim 1 wherein
the diaphragm section has a round, circular peripheral edge, forming an inner concave surface portion and an outer convex surface portion.

7. A transducer as defined in claim 1 wherein
the outer apex surface portion includes an annular groove defining an inner center section and an outer annular ring section,
said inner center section being effective to vibrate at high frequencies thereby acting as a speaker radiator element.

8. A transducer as defined in claim 1 wherein
the mounting means includes a plurality of spring members secured at one end to the diaphragm section and at the other end to the driver assembly.

9. A transducer as defined in claim 8 wherein
the resilient mounting means includes means for adjustably securing the spring members to the inner, dished surface of the diaphragm section.

10. A transducer as defined in claim 1 wherein
the coil member includes a conical portion coupled to the cylindrical portion and having a vertex section attached to the stem means, and
the magnetic gap is located between the front disk pole member and the outer surface of the cylindrical bore member.

11. A transducer as defined in claim 1 wherein
acoustic damping material is disposed on the inner dished surface portion and on a side of the driver assembly facing said inner dished surface portion.

12. A transducer as defined in claim 1 wherein
damping fluid material is disposed in the magnetic gap.

13. A transducer as defined in claim 1 wherein
the housing includes a cover means including a top portion and a skirt portion which extends over the cylindrical section with the top portion covering over said outer rear end.

14. A transducer as defined in claim 13 wherein
the skirt portion extends forwardly from the outer rear end toward the panel means, said skirt portion having an outer edge laterally spaced from the panel means.

15. A transducer as defined in claim 13 wherein the skirt portion extends forwardly from the outer rear end to the panel means and includes a grill section adjacent the panel means.

16. A transducer as defined in claim 1 wherein the housing includes weight means to increase the moment of inertia of the transducer.

17. A transducer as defined in claim 16 wherein the weight means is integrally formed with cover means which extend over the cylindrical section and said outer rear end.

18. A transducer as defined in claim 1 wherein the housing includes cover means having grill means extending over said outer rear portion.

19. A transducer as defined in claim 18 wherein the grill means includes acoustic resistance material.

20. A transducer as defined in claim 1 wherein there are at least two said transducer housings laterally disposed with respect to each other on the same panel means.

21. A transducer as defined in claim 1 wherein the apex region of the surface portion and the stem means are eccentrically located on the diaphragm section.

22. A transducer as defined in claim 1 wherein the housing includes a resonator chamber having resonator means disposed therein, said resonator means being effective to assist the frequency response of the transducer.

23. A transducer as defined in claim 22 wherein the resonator means includes at least one weighted mass suspended with spring means mounted in the resonator chamber.

24. A transducer as defined in claim 23 wherein the resonator means includes mechanical damping means.

25. A transducer as defined in claim 1 wherein the panel means includes a panel diaphragm having a shape and size to fasten directly over a further loud speaker to form a speaker combination, said panel diaphragm being effective to allow low frequency sound to pass through the panel diaphragm which supports the transducer housing.

26. A transducer as defined in claim 25 wherein the panel diaphragm includes perforations through which said low frequency sound passes.

27. A transducer as defined in claim 26 wherein the panel diaphragm includes acoustical damping material disposed on the side of the diaphragm facing the further loud speaker, said damping material being effective to reduce standing waves that create peaks and dips in the frequency response of the speaker combination.

28. A transducer as defined in claim 25 wherein the panel diaphragm includes resilient mounting means to connect the panel diaphragm to the further loud speaker, said resilient mounting means being effective to improve durability and frequency response of the speaker combination.

29. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, and (e) mounting means secures an electromagnetic driver assembly to the inner dished surface portion of the diaphragm section, (f) the driver assembly includes a front pole surface facing the diaphragm section and a rear pole surface facing in a direction away from the diaphragm section with a bore opening extending completely therethrough, (g) the driver assembly further includes driver anchoring means connected at one end to the stem means extending through the bore opening and connected at the other end thereof to a securing member which extends outwardly from the bore opening and contacts the rear pole surface.

30. A transducer as defined in claim 29 wherein the anchoring means includes a spring section biassingly connecting the securing member to the stem means.

31. A transducer as defined in claim 29 wherein the anchoring means includes means for adjusting a biassing force between the stem means and the securing member.

32. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, and (e) mounting means secures an electromagnetic driver assembly to the inner, dished surface portion of the diaphragm section, (f) the electromagnetic driver assembly includes a cylindrical ring magnet having a circular disk, rear pole member on a rear side facing in a direction away from the diaphragm section, a circular disk, front pole member on a front side facing the diaphragm section and a cylindrical bore member having an outer surface and extending through the ring magnet between the front and rear sides, (g) an annular magnetic gap is located between one of the disk pole members and the outer surface of the cylindrical bore member, and (h) the annular gap is located between the rear disk pole member and the outer surface of the cylindrical bore member, (i) the stem means is coupled to the voice coil means which is located in said magnetic gap.

33. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, and (e) mounting means secures an electromagnetic driver assembly to the inner, dished surface portion of the diaphragm section, (f) the electromagnetic driver assembly includes a cylindrical ring magnet having a circular disk, rear pole member on a rear side facing in a direction away from the diaphragm section, a circular disk, front pole member on a front side facing the diaphragm section and a cylindrical bore member having an outer surface and extending through the ring magnet between the front and rear sides, (g) an annular magnetic gap is located between one of the disk pole members and the outer surface of the cylindrical bore member, and (h) the voice coil means including voice coil coupling means resiliently connecting the voice coil means to the stem means to retard natural resonances of the panel means, (i) the voice coil means including a voice coil located in said magnetic gap.

34. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, and (e) mounting means secures an electromagnetic driver assembly to the inner, dished surface portion of the diaphragm section, (f) the electromagnetic driver assembly includes a cylindrical ring magnet having a circular disk, rear pole member on a rear side facing in a direction away from the diaphragm section, a circular disk front pole member on a front side facing the diaphragm section and a central center pole member having an outer surface section and extending through the ring magnet, (g) an annular magnetic gap is located between the front disk pole member and the outer surface of the center pole member, and (h) a voice coil assembly is connected at one end thereof to the stem means and has a cylindrical voice coil member at the other end thereof disposed in the magnetic gap.

35. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, and (e) resilient mounting means secures an electromagnetic driver assembly to the inner dished surface portion of the diaphragm section, (f) the driver assembly includes a front disk pole member having a surface facing the diaphragm section, a rear disk pole member having a surface facing in a direction away from the diaphragm section, and a center pole member, (g) the resilient mounting means including a support structure connected at one end thereof to the driver assembly and coupling means located at the other end thereof connected to the stem means.

36. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, and (e) resilient mounting means secures an electromagnetic driver assembly to the inner dished surface portion of the diaphragm section, (f) the driver assembly includes a front disk pole member having a surface facing the diaphragm section, a rear disk pole member having a surface facing in a direction away from the diaphragm section, and a center pole member with a bore opening extending completely therethrough, (g) the driver assembly includes driver anchoring means having a securing means extending outwardly from the bore opening and contacting the rear pole surface, (h) the stem means has a length sufficient to penetrate the securing means and the bore opening in addition to the diaphragm section and panel means.

37. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, (e) mounting means secures an electromagnetic driver assembly to the inner dished surface portion of the diaphragm section, (f) the driver assembly includes a front disk pole member having a surface facing the diaphragm section, a rear disk pole member having a surface facing in a direction away from the diaphragm section, and a center pole member, and (g) electrical contact means including first contact leads located on the outer surface portion disposed to electrically connect to second contact lead means disposed on the panel means.

38. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, (e) electrical contact means including first contact leads located on the outer surface portion disposed to electrically connect to second contact lead disposed on the panel means, (f) the second contact leads include two concentric ring contact elements located around the stem means, and (g) the first contact leads include two separate contact elements effective to contact one of each of the ring contact elements.

39. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, and (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, (e) the panel means including a panel diaphragm adapted to fasten directly over a loudspeaker cone opening to form a speaker combination and including means for mounting said panel diaphragm to cover such loudspeaker cone opening while allowing low frequency sound to pass through the panel diaphragm.

40. A sound transducer for converting electrical signals into mechanical motion, said transducer comprising:

(a) a transducer housing including a diaphragm section having an inner dished surface portion and an outer apex surface portion with an apex region, (b) stem means projecting outwardly from the apex surface portion and having a structural configuration effective to penetrate a panel means, (c) securing means adapted to cooperate with the stem means for fixing a panel means between the apex region of the surface portion and the securing means, (d) whereby when a combination formed by the transducer housing fixed against a panel means, said combination defines a 360 degree acoustical horn with the panel means constituting one wall of the horn, (e) mounting means secures an electromagnetic driver assembly to the inner dished surface portion of the diaphragm section, (f) the driver assembly includes a front disk pole member having a surface facing the diaphragm section, a rear disk pole member having a surface facing in a direction away from the diaphragm section, and a center pole member, and (g) the panel means includes a panel diaphragm having a shape and size to fasten directly over a further loud speaker to form a speaker combination, (h) said panel diaphragm being effective to allow low frequency sound to pass through the panel diaphragm which supports the transducer housing, (i) the panel diaphragm including a weight secured to a side of the panel diaphragm to control panel resonance and standing waves.

41. A transducer as defined in claim 40 wherein the weight includes an annular ring bonded to the panel diaphragm.

42. A sound transducer for converting electrical signals into mechanical motion, said transducer comprising:

(a) a transducer housing including a diaphragm section having an inner surface and an outer surface, (b) stem means projecting outwardly from said housing diaphragm section and having a structural configuration effective to penetrate a panel means, (c) securing means adapted to cooperate with the stem means for connecting the diaphragm housing section to a panel means, and (d) resilient mounting means fixedly securing an electromagnetic driver assembly to the inner surface of the diaphragm housing section, (e) the driver assembly includes a front disk pole member having a surface facing the diaphragm section, a rear disk pole member having a surface facing in a direction away from the diaphragm section, and a center pole member, (f) the electromagnetic driver assembly further including an annular magnetic gap and voice coil means located in said magnetic gap, (g) said voice coil means including a coil member having a cylindrical voice coil portion at one end thereof disposed in the magnetic gap and the other end thereof connected to the stem means.

43. A transducer as defined in claim 42 wherein the coil member includes a conical portion coupled to the cylindrical portion and having a vertex section attached to the stem means.

44. A transducer as defined in claim 42 wherein the stem means includes a stud member having outer threads and a female insert member having inner threads which engage the outer threads of the stud member, the female insert member extends through the diaphragm section to hold the diaphragm section against the panel means.

45. A transducer as defined in claim 42 wherein the diaphragm section includes an inner section, center section and an outer, annular ring section, the inner, center section has a cross-sectional thickness that is thinner than the outer, annular ring section.

46. A transducer as defined in claim 42 wherein the housing includes a resonator chamber portion in which at least one spring-mounted mass is disposed to assist the frequency response of the transducer.

47. A transducer as defined in claim 42 wherein the stem means includes a coaxial bolt assembly having a hollow bolt member, a pin member and an electrical insulating sleeve member, the hollow bolt member has a central bore which receives the pin member with the sleeve member being disposed in the bore between the pin member and the bolt member, said hollow bolt member and said pin member being electrically connected to constitute respective electrical terminals for the transducer.

48. a sound transducer for converting electrical signals into mechanical motion, said transducer comprising:

(a) a transducer housing including a diaphragm section having an inner surface and an outer surface, (b) stem means projecting outwardly from said housing diaphragm section and having a structural configuration effective to penetrate a panel means, (c) securing means adapted to cooperate with the stem means for connecting the diaphragm housing section to a panel means, and (d) resilient mounting means fixedly securing an electromagnetic driver assembly to the inner surface of the diaphragm housing section, (e) the housing includes cover means having eccentrically located weight means.

* * * * *